US009949569B1

(12) United States Patent
Moorehead

(10) Patent No.: US 9,949,569 B1
(45) Date of Patent: Apr. 24, 2018

(54) CO-SLEEPER BED SYSTEM

(71) Applicant: Katie Moorehead, Valparaiso, IN (US)

(72) Inventor: Katie Moorehead, Valparaiso, IN (US)

( * ) Notice: Subject to any disclaimer, the term of this patent is extended or adjusted under 35 U.S.C. 154(b) by 0 days.

(21) Appl. No.: 15/705,981

(22) Filed: Sep. 15, 2017

(51) Int. Cl.

| | |
|---|---|
| ***A47C 19/02*** | (2006.01) |
| ***A47C 19/22*** | (2006.01) |
| ***A47D 5/00*** | (2006.01) |
| ***A47B 23/02*** | (2006.01) |
| ***A47D 7/04*** | (2006.01) |
| ***A47D 7/02*** | (2006.01) |
| ***A47C 17/86*** | (2006.01) |

(52) U.S. Cl.
CPC ..... *A47C 19/028* (2013.01); *A47B 23/025* (2013.01); *A47C 17/86* (2013.01); *A47C 19/025* (2013.01); *A47C 19/22* (2013.01); *A47D 5/00* (2013.01); *A47D 7/02* (2013.01); *A47D 7/04* (2013.01)

(58) Field of Classification Search
CPC ..... A47B 23/00; A47B 23/002; A47B 23/025; A47C 17/00; A47C 17/86; A47C 19/005; A47C 19/021; A47C 19/025; A47C 19/00; A47C 19/20; A47C 19/205; A47C 19/028; A47C 19/22; A47C 19/202; A47D 5/00; A47D 7/00; A47D 7/007; A47D 7/01; A47D 7/02; A47D 7/04
USPC ..... 5/2.1–7
See application file for complete search history.

(56) References Cited

U.S. PATENT DOCUMENTS

| | | | | | |
|---|---|---|---|---|---|
| 962,767 | A * | 6/1910 | Lawyer | A47D 7/04 | 5/282.1 |
| 1,146,031 | A * | 7/1915 | Sommer | A47D 7/04 | 5/51.1 |
| 1,590,550 | A * | 6/1926 | Rece | A47D 7/04 | 5/95 |
| 1,920,580 | A * | 8/1933 | McGlauthen | A47D 7/04 | 248/274.1 |
| 2,537,539 | A * | 1/1951 | McLendon | A47C 19/22 | 5/95 |
| 2,721,336 | A * | 10/1955 | Becker | A47D 7/007 | 5/2.1 |
| 3,383,718 | A * | 5/1968 | Spencer | A47D 7/02 | 5/100 |
| 5,148,561 | A | 9/1992 | Tharalson et al. | | |
| 5,423,597 | A * | 6/1995 | Rogers | | |
| 6,862,757 | B2 | 3/2005 | Andriunas et al. | | |

(Continued)

*Primary Examiner* — David E Sosnowski
*Assistant Examiner* — Amanda L Bailey
(74) *Attorney, Agent, or Firm* — Dale J. Ream

(57) ABSTRACT

A co-sleeper bed system includes a primary bed framework having a primary enclosure that includes a floor and first and second side guide rails defining an open top for receiving a primary mattress. The bed system includes an auxiliary bed frame having frame members that receive an auxiliary mattress, the auxiliary bed frame having a first support leg depending from the plurality of frame members. The first support leg includes a flange slidably received in a channel of the first guide rail. The bed system includes a crib framework having a floor for supporting a crib mattress and a plurality of leg hubs each having a truncated configuration extending downwardly. A pair of slider flanges is attached to a pair of inner leg hubs, each slider flange being slidably received in the channel of the second guide rail for removably coupling the crib framework to the primary framework.

16 Claims, 17 Drawing Sheets

(56) References Cited

U.S. PATENT DOCUMENTS

| | | | | |
|---|---|---|---|---|
| 6,931,677 | B2 | 8/2005 | Tharalson et al. | |
| 7,013,505 | B2 | 3/2006 | Martin | |
| 2005/0273929 | A1* | 12/2005 | Hennings ..... | A47C 19/00 5/201 |

* cited by examiner

CO-SLEEPER BED SYSTEM

BACKGROUND OF THE INVENTION

This invention relates generally to bed systems and, more particularly, to a co-sleeper bed system that enables a primary bed (e.g. a full size mattress bed) to be the centerpiece of a modular combination that accepts attachment of an auxiliary bed frame (e.g. a trundle bed), a baby crib, a changing table, and accessory tables (e.g. night stands).

It is common for parents to bring their young children into their own full sized bed at night for a variety of reasons, such as to save repeated trips to the baby's room to comfort a crying infant or to relieve the anxieties of a toddler who may be nervous in the dark or during a storm. The reality is that needing to maintain this "alternative" sleeping arrangement often becomes a nightly routine for many weeks or months and may be experienced through many children within a family for years, such as during both infant and toddler years and as more children are added to the family unit. In fact, many family units may simply desire the "togetherness" of having one or more children sleeping in the same room. Naturally, however, it is difficult, unsafe, or even impossible to have an infant or toddler on the same mattress all the time as the adult may roll over onto the infant or it is simply too crowded with the toddler between the adults. In addition, there needs to be an easier way to "transition" a child back into his normal bed and back to his own room.

Various co-sleeper bed systems have been proposed in the prior art to facilitate having an infant close at hand to the bed of the parents or caregiver. Although presumably effective for their intended purposes, the existing and proposed bed systems do not enable a crib, trundle bed, and crib to be removably coupled to the primary bed frame, slidably positioned, and then released to return to the child's own room when not needed or desired.

Therefore, it would be desirable to have a co-sleeper bed system that enables the beds of parents, toddlers, and infants to selectively interconnect or be separated. Further, it would be desirable to have a co-sleeper bed system that is modular so that an auxiliary bed (e.g. a so-called trundle bed), crib, changing table, and nightstand tables may be interconnected with a primary bed framework in selected arrangements.

SUMMARY OF THE INVENTION

A co-sleeper bed system according to the present invention includes a primary bed framework having a primary enclosure supported above a floor surface by a support structure, the primary enclosure including a floor and first and second side guide rails that, together, define an open top for receiving a primary mattress atop the floor. The bed system includes an auxiliary bed frame that includes an auxiliary enclosure having a plurality of frame members configured to receive an auxiliary mattress, the auxiliary bed frame having a first support leg depending from the plurality of frame members. The first support leg includes a flange slidably received in a channel of the first guide rail.

The bed system includes a crib framework having a floor for supporting a crib mattress and a plurality of leg hubs each having a truncated configuration extending downwardly from corners of the floor. A pair of slider flanges is attached to a pair of inner leg hubs of the plurality of leg hubs, each slider flange being slidably received in the channel of the second guide rail for removably coupling the crib framework to the primary framework. A pair of outer support legs are removably coupled to and extending downwardly from a pair of outer leg hubs of the plurality of leg hubs for supporting the crib framework when the pair of crib fasteners is coupled to the second receiving member of the second side member of the primary bed framework. A pair of inner support legs is removably coupled to and extending downwardly from the inner leg hubs, respectively, when the slider flanges are removed from the inner leg hubs.

Therefore, a general object of this invention is to provide a co-sleeper bed system which enables the beds of parents, toddlers, and infants to selectively interconnect or be separated.

Another object of this invention is to provide a co-sleeper bed system, as aforesaid, that is modular so that an auxiliary bed (e.g. a so-called trundle bed), crib, changing table, and nightstand tables may be interconnected with a primary bed framework in selected arrangements.

Still another object of this invention is to provide a co-sleeper bed system, as aforesaid, having tongue-and-groove slidable attachments so that components may be slidably positioned, attached, and released quickly yet securely.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
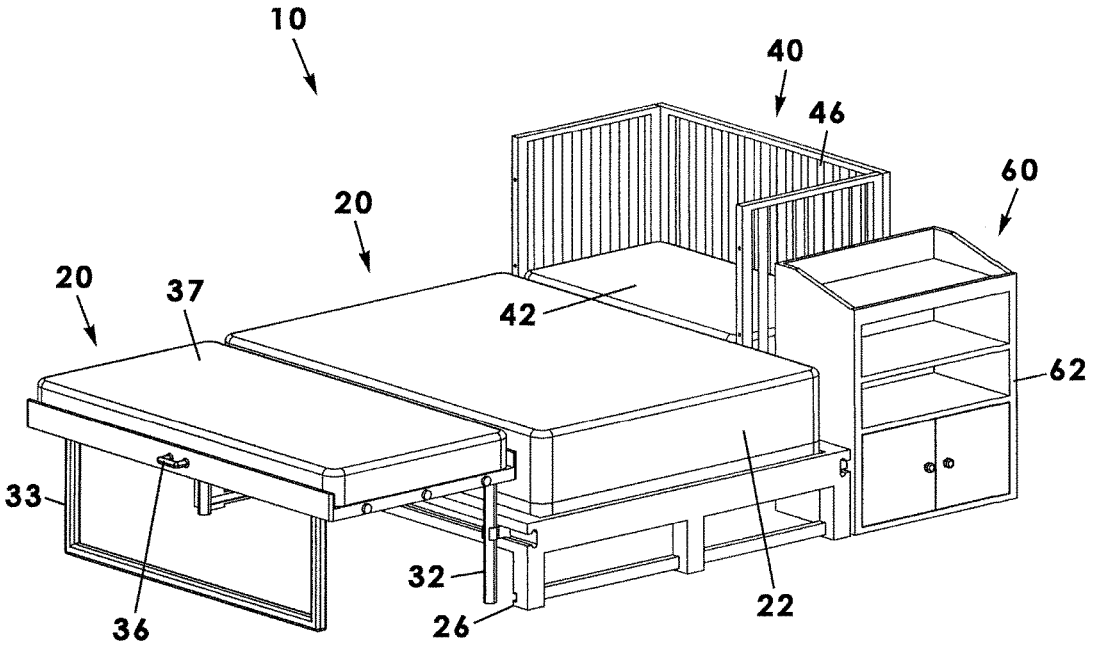
FIG. 1 is a perspective view of a co-sleeper bed system according to a preferred embodiment of the present invention.

A co-sleeper bed system according to a preferred embodiment of the present invention will now be described in detail with reference to FIGS. 1 to 23 of the accompanying drawings. The co-sleeper bed system 10 includes a primary bed framework 20, an auxiliary bed frame 30, a crib 40, and a changing table 60. The frames include modular components so that multiple arrangements of the sleeping assemblies is possible. In other words, the primary bed, a trundle bed, a crib, and the changing table may be attached and used as a single unit or may be removed and used independently.

A primary bed assembly includes the primary bed framework 20 that is associated with an adult sized bed, such as a queen sized bed although other sizes of beds would also work. The primary bed framework 20 includes a primary enclosure 21 supported above a floor surface and is configured to receive and support a primary mattress 22. More particularly, the primary enclosure 21 includes a floor 23 bounded by opposed first 24 and second 25 support members. Collectively, the support members define an open top of the primary enclosure 21 for receiving a primary mattress 22 onto the floor 23 of the primary enclosure 21.

Each of the first 24 and second 25 support members include first 24*a* and second 25*a* receiving members, respectively. The first support member 24 may be a first guide rail and the first receiving member 24*a* may be a first channel defined by the first support member 24. Likewise, the second support member 25 may be a second guide rail and the second receiving member 25*a* may be a channel defined by the second support member 25. As will be described in more detail below, other components of the co-sleeper bed system 10 may include one or more fasteners configured to mate or nest in a respective receiving member and be slidable therein, such as in a tongue-and-groove engagement.

An auxiliary bed assembly includes an auxiliary bed frame 30 having an auxiliary enclosure 31 that includes one or more frame members configured to receive an auxiliary mattress 37. It is understood that the dimensions of the auxiliary bed frame 30 are proportionately smaller than the dimensions of the primary bed framework 20 in the nature of a so-call trundle bed, which is defined as a smaller, lower bed storable under a larger bed and often on wheels. Regarding selective attachment, the auxiliary bed frame 30 includes at least a first support leg 32 extending downwardly from the plurality of frame members of the auxiliary bed frame 30. The first support leg 32 may include a fastener selectively and removably coupled to the first receiving member 24*a* of the primary bed framework 20. In an exemplary embodiment, the fastener may be a flange 24*a* configured for slidable reception into the channel of the first guide rail, such as in a tongue-and-groove engagement. This engagement enables the auxiliary bed frame 30 to be slidably positioned adjacent the primary bed framework 20. The dimensions of the components described above are such that the top surface of the primary mattress 22 and auxiliary mattress 37 are generally level with one another when the auxiliary bed frame 30 is coupled to the first guide rail 26 of the primary bed framework 20.

Figure 2:
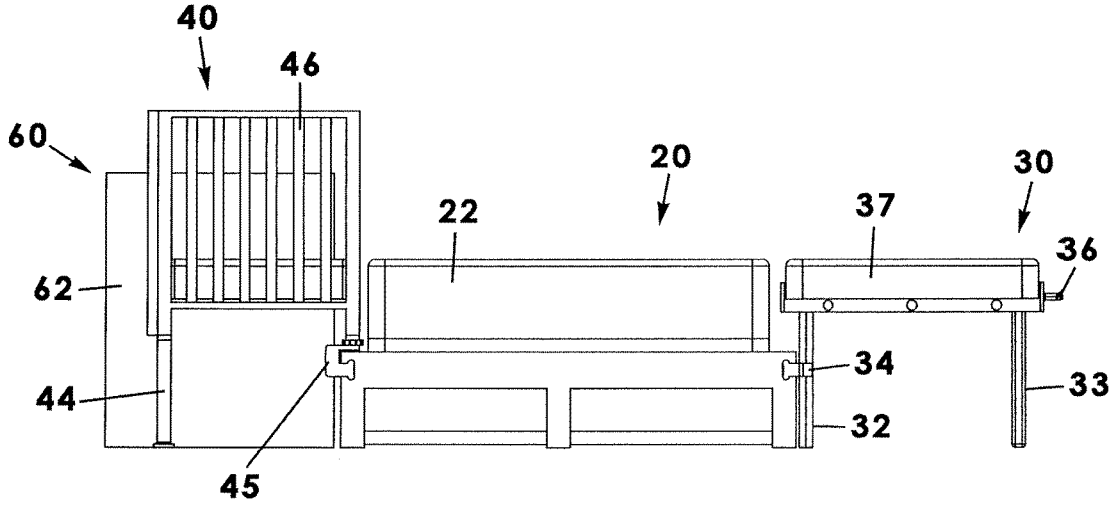
FIG. 2 is a rear view of the bed system as in FIG. 1.
Figure 3:
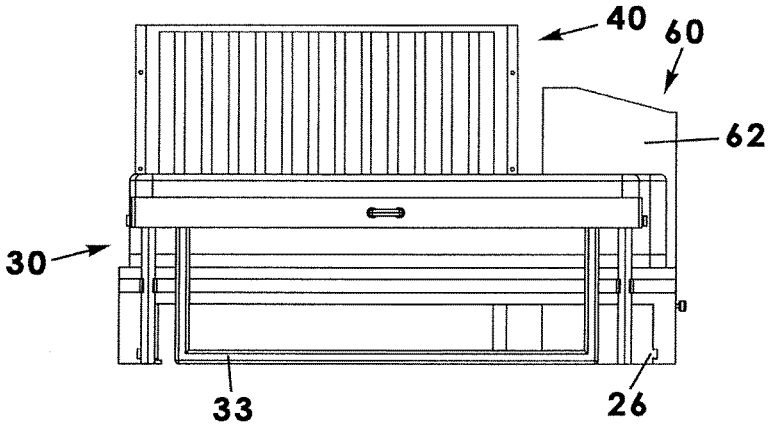
FIG. 3 is a side view of the bed system as in FIG. 1.
Figure 4:
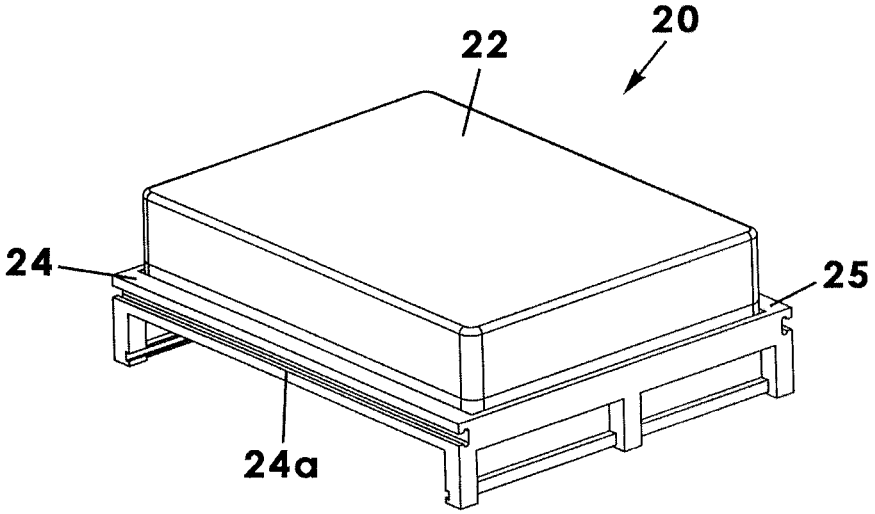
FIG. 4 is an isolated perspective view of the primary bed assembly removed from the bed system shown in FIG. 1.
Figure 5:
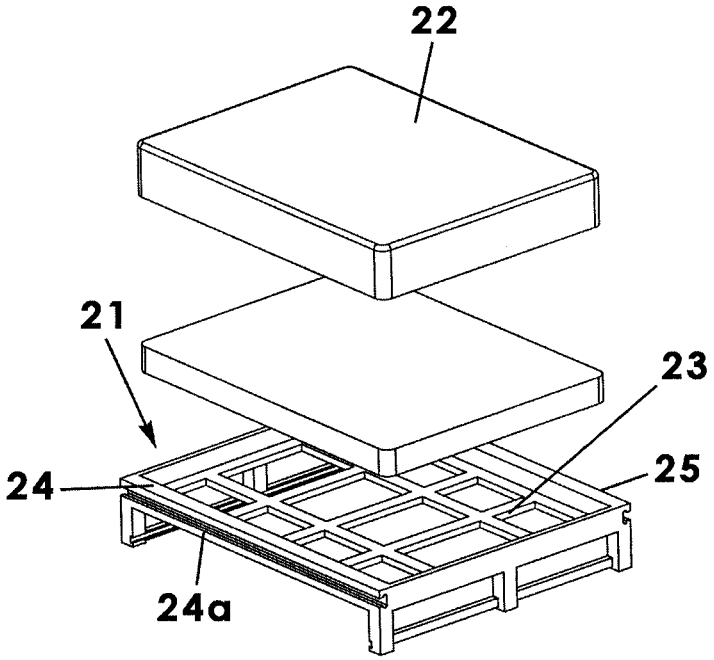
FIG. 5 is an exploded view of the primary bed framework as FIG. 4.

With further reference to the auxiliary bed frame 30, the first support leg 32 may be pivotally coupled to one frame member and preferably to the frame member most adjacent to the primary bed framework 20 when attached thereto. The first support leg 32 is pivotal between 1) a stowed configuration situated underneath the auxiliary bed frame 30 and generally parallel to respective frame members and 2) a deployed configuration extending away from and generally perpendicular to the frame members (FIG. 2). At the deployed configuration, the first support leg 32 supports the auxiliary bed frame 30 above a floor surface and substantially bears the weight of a person recumbent thereon.

Figure 6:
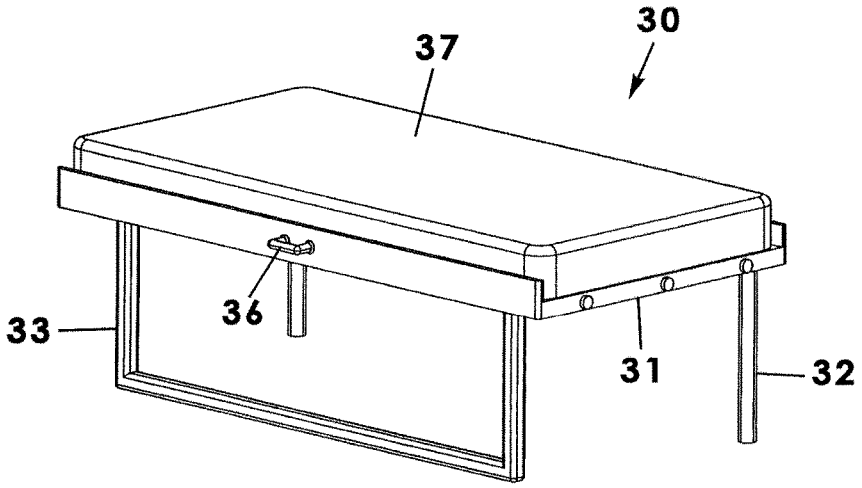
FIG. 6 is an isolated perspective view of the auxiliary bed assembly removed from the bed system shown in FIG. 1.
Figure 7:
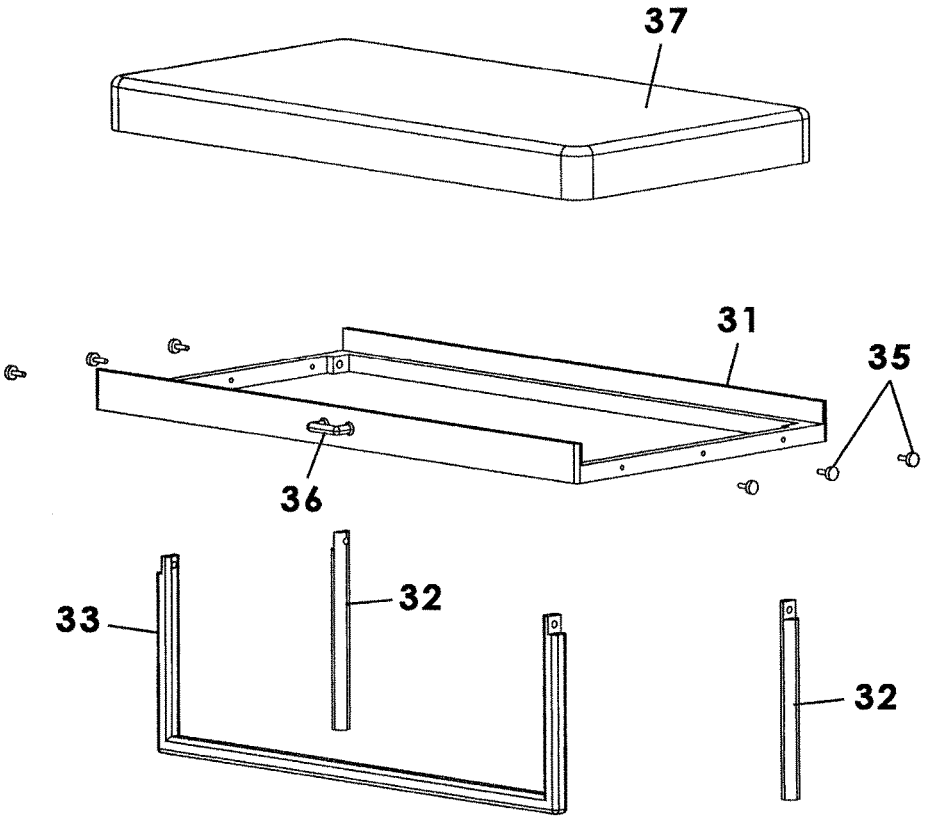
FIG. 7 is an exploded view of the auxiliary bed assembly as in FIG. 6.
Figure 8A:
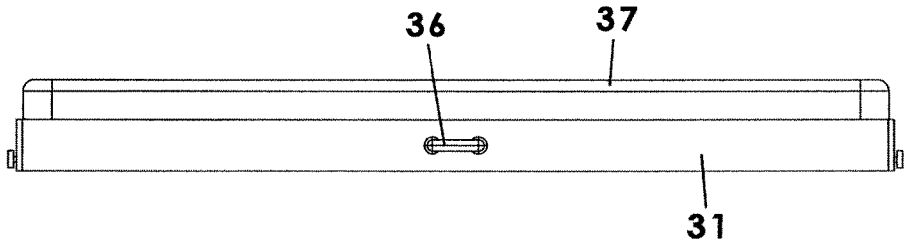
FIG. 8*a* is a front view of the auxiliary bed assembly in a collapsed configuration.
Figure 8B:
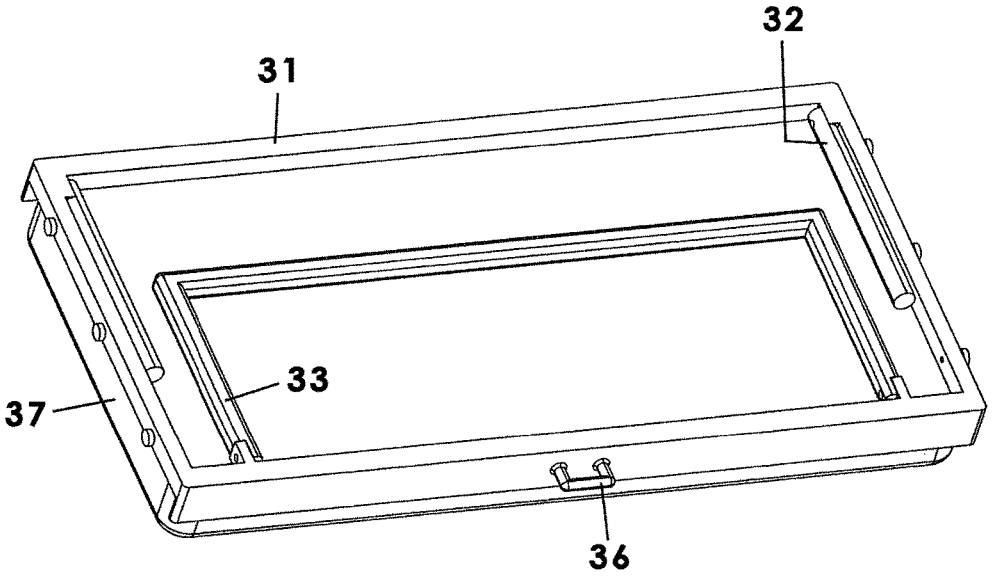
FIG. 8*b* is a perspective view of an underside of the auxiliary bed frame.
Figure 9:
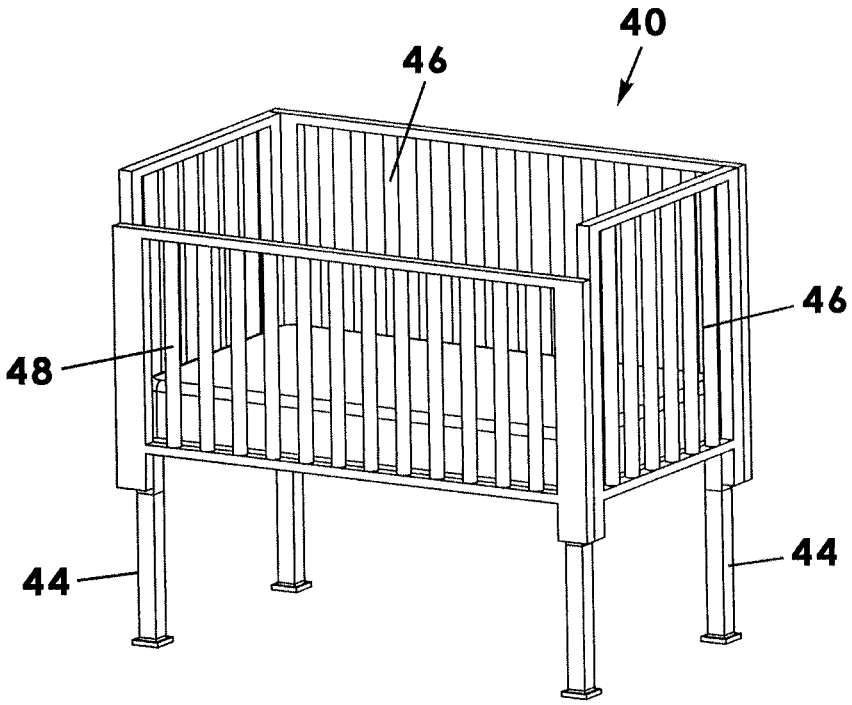
FIG. 9 is a perspective view of a crib assembly removed from the bed system as in FIG. 1.

Further, the auxiliary bed frame 30 may include a second support leg 33 displaced from the first support leg 32 and pivotally coupled to a frame member opposite the frame member to which the first support leg 32 is coupled. The second support leg 33 is also pivotally movable between 1) a stowed configuration situated underneath the auxiliary bed frame 30 and generally parallel to respective frame members and 2) a deployed configuration extending away from and generally perpendicular to the frame members (FIG. 6). At the deployed configuration, the second support leg 33 supports the auxiliary bed frame 30 above a floor surface and enhances the bearing of weight of a person recumbent thereon. It is understood that when both support legs are deployed, the auxiliary bed frame 30 may be used as a standalone bed detached from the primary bed framework 20 (FIG. 6).

Figure 13A:
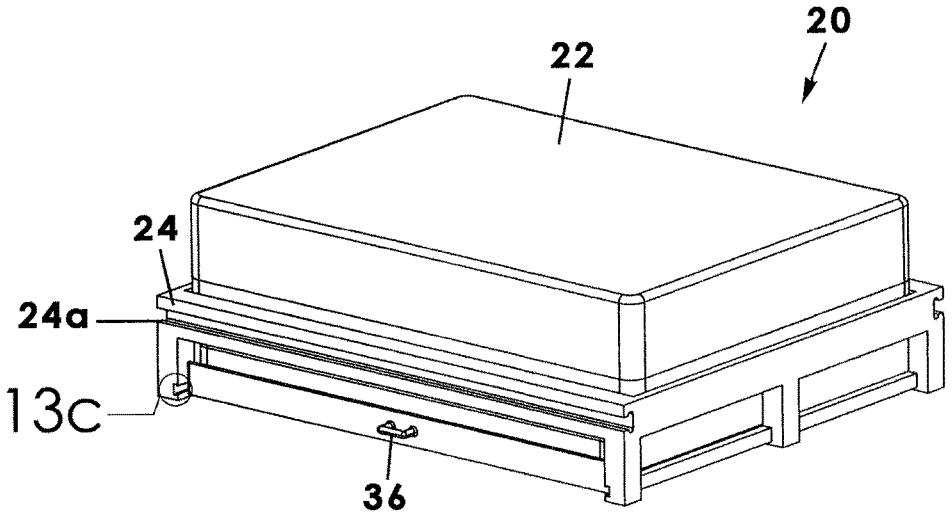
FIG. 13*a* is a perspective view of the auxiliary bed frame and primary bed framework illustrated in a stowed configuration.
Figure 13B:
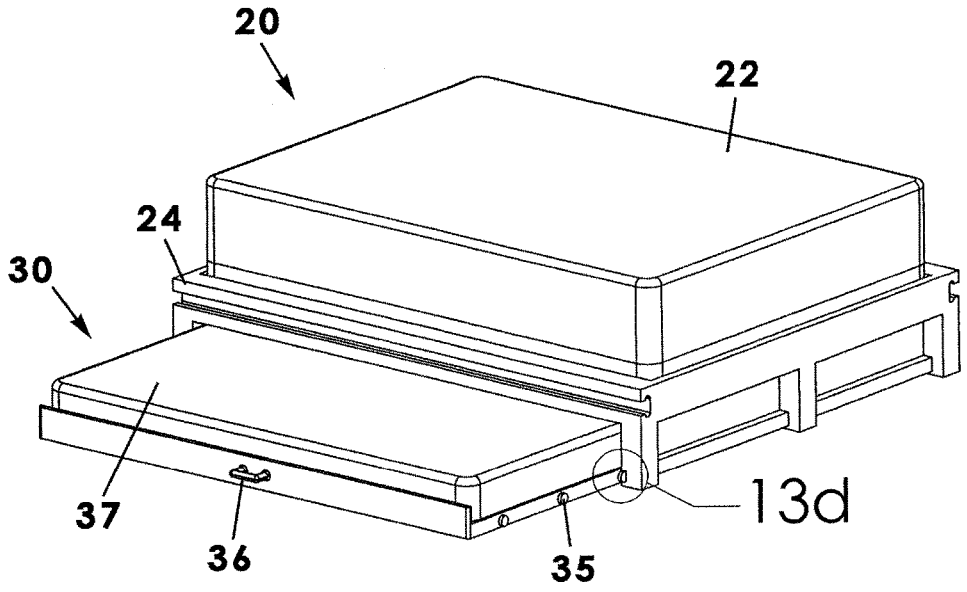
FIG. 13*b* is a perspective view of the auxiliary bed frame and primary bed framework illustrated in a partially deployed configuration.
Figure 13C:
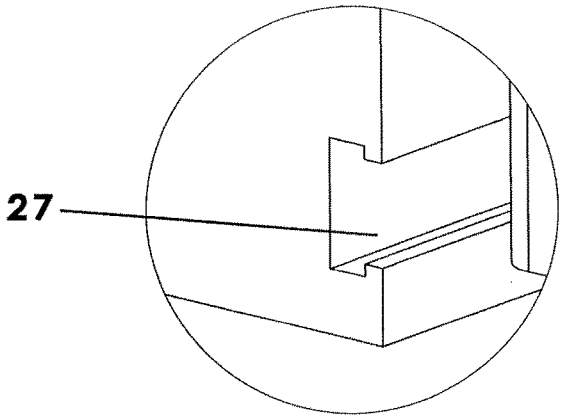
FIG. 13*c* is an isolated view on an enlarged scale taken from FIG. 13*a;*
Figure 13D:
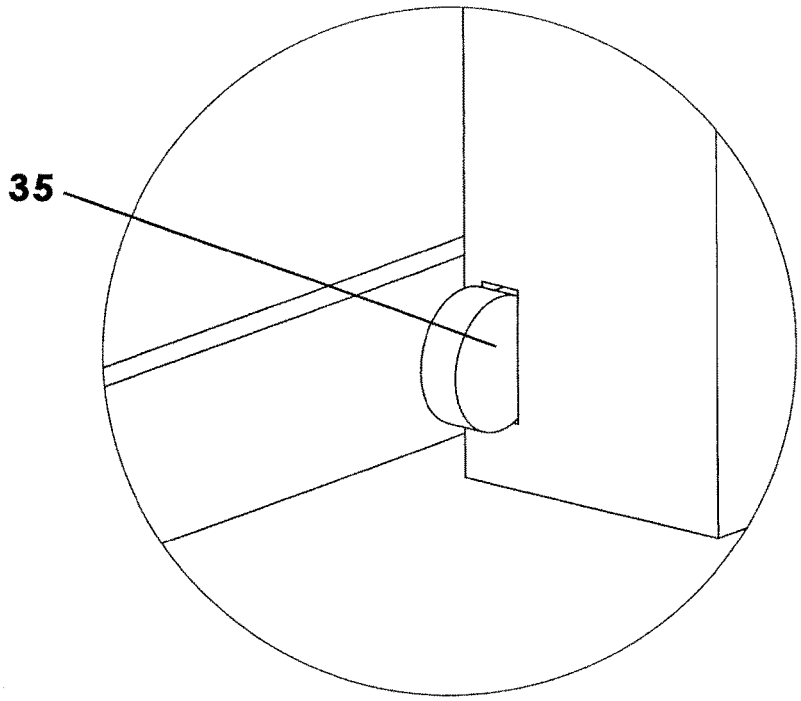
FIG. 13*d* is an isolated view on an enlarged scale taken from FIG. 13*b;*
Figure 14A:
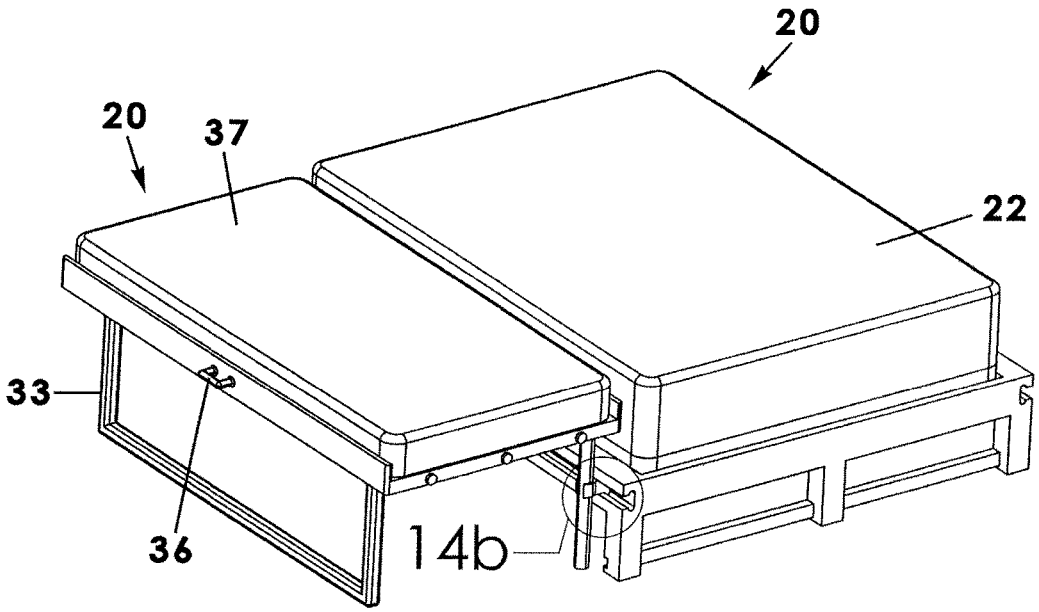
FIG. 14*a* is a perspective view of the auxiliary bed frame and primary bed framework illustrated in a fully deployed configuration.
Figure 14B:
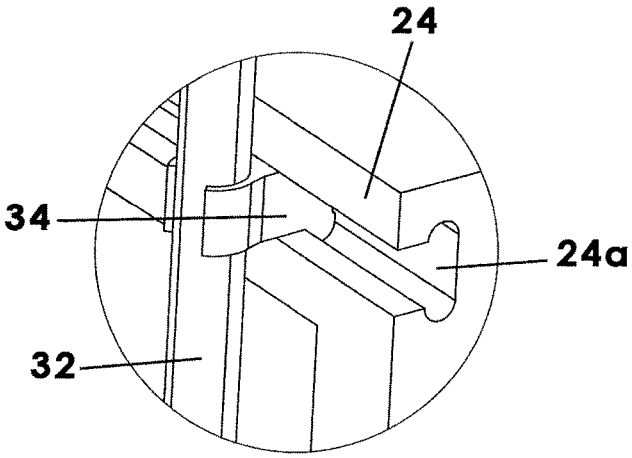
FIG. 14*b* is an isolated view on an enlarged scale taken from FIG. 14*a;*

A handle 36 may be coupled to the auxiliary bed frame 30 and, preferably, to an outer frame member ("outer frame member" is referring to the side that is free and opposite the primary bed framework 20 as shown in FIG. 1). The auxiliary bed frame 30 is storable underneath the primary bed framework 20 and may be pulled out or pushed under using the handle 36. When the first support leg 32 and second support leg 33 are moved pivotally to respective stowed configurations as described above and shown in FIG. 8*b*, the auxiliary bed frame 30 takes on a generally collapsed or flattened configuration having a planar configuration that is parallel with a floor surface, the collapsed auxiliary bed frame 30 having a dimension smaller than a dimension of the primary bed framework 20 so that it may be stowed under the primary bed framework 20 (FIGS. 13*a* and 13*b*).

In an embodiment, the support structure of the primary bed framework 20 includes a front guide rail 26 and a rear guide rail 27 extending between the first and second side support members 24, 25, the guide rails being opposite and parallel to one another (see together FIGS. 13*b*, 13*c*, 16*b* and 17. Then, the plurality of frame members of the auxiliary bed frame 30 include one or more rollers 35, respectively, the rollers 35 having complementary configurations and being selectively engaged with respective first and second guide rails for selectively storing the auxiliary bed frame 30 beneath the primary bed framework 20 (FIG. 13*a*).

In another aspect, the co-sleeper apparatus 10 includes a crib 40 (also referred to as the "crib assembly") that is also selectively and removably coupled to the primary bed framework 20 or used apart from the primary bed framework 20. More particularly, the crib includes a crib framework having a floor 41 for supporting a crib mattress 42 thereon. The crib framework has a plurality of leg hubs 43, each leg hub 43 having a truncated configuration extending downwardly from respective corners of the floor 41. The leg hubs 43 are spaced apart from one another. The inner leg hubs (referring to the leg hubs most proximate the primary bed framework 20 when attached thereto) may each include a crib fastener 45 selectively and releasably coupled to the second receiving member 25*a* of the primary bed framework 20. In an embodiment, the second support member 25 includes a second guide rail defining a channel and each crib fastener 45 is a slider flange configured for selective and slidable engagement along the channel of the second guide rail. Accordingly, the crib framework may be slidably coupled to the primary bed framework, slidably positioned forwardly or rearwardly along the channel of the second guide rail, or disengaged so that the crib 40 may be moved to another room or the like. When the crib framework is coupled to the primary bed framework, a top surface of the crib mattress 42 is substantially even, co-planar, or level with the top surface of the primary mattress 22.

Opposite the inner leg hubs, a pair of outer leg hubs (referring to the leg hubs most displaced from the primary bed framework 20) extends downwardly from the floor 41 of the crib framework. Together, the inner and outer leg hubs may include inner and outer support legs, respectively, for supporting the crib above the floor. When coupled to the primary bed framework, inner support legs may be removed from associated inner hubs while the outer support legs may remain coupled to associated outer hubs.

Figure 10:
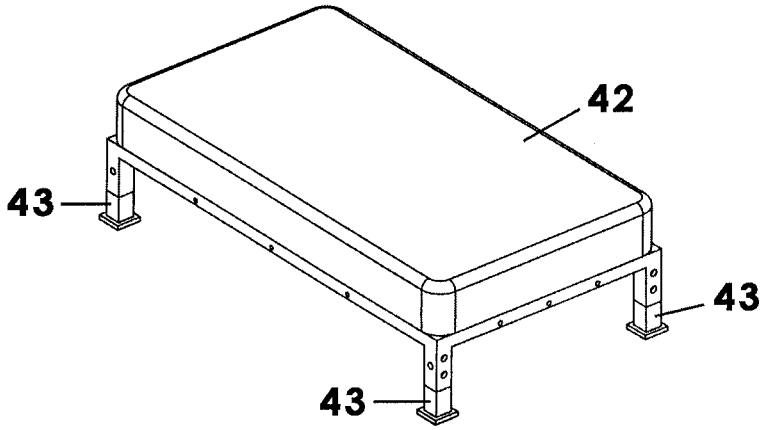
FIG. 10 is a perspective view of the crib as in FIG. 9 having the support legs and side panels removed.
Figure 11:
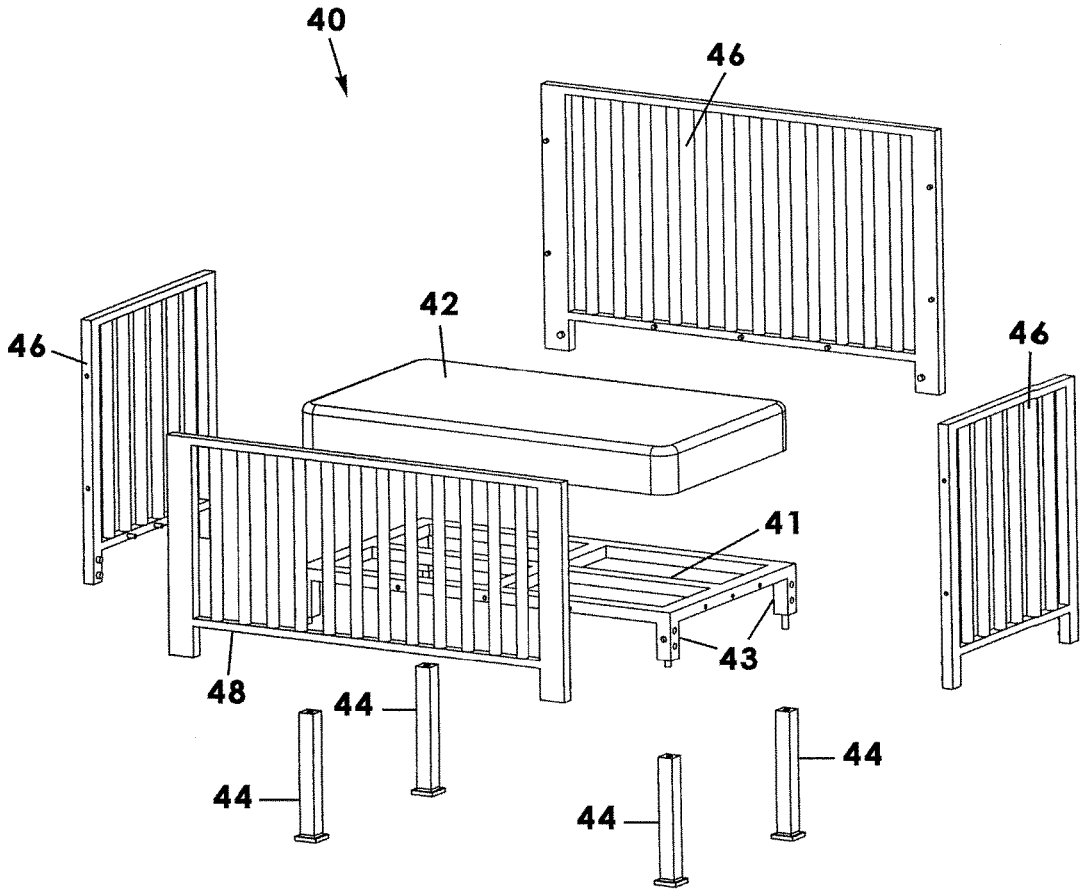
FIG. 11 is an exploded view of the crib assembly as in FIG. 9.
Figure 15:
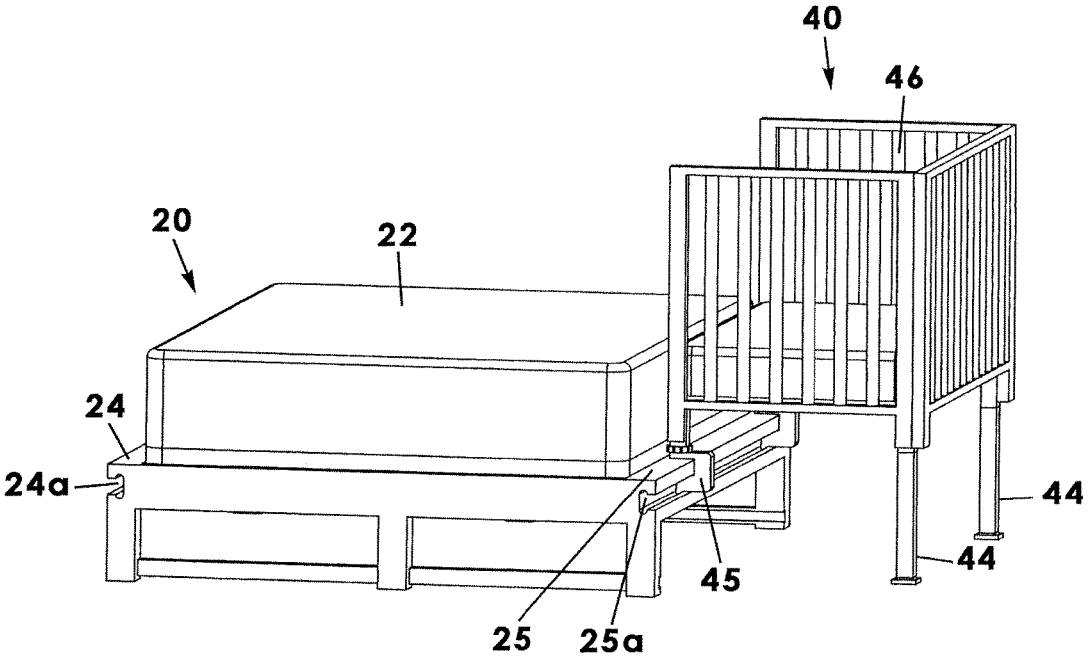
FIG. 15 is a perspective view of the crib assembly coupled to the primary bed framework.
Figure 16A:
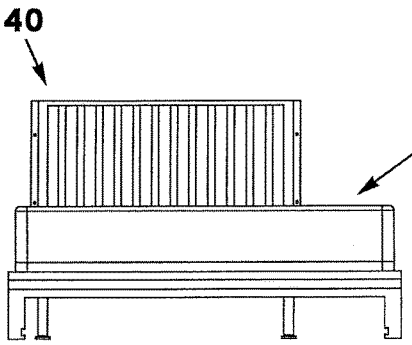
FIG. 16*a* is a side view of the crib assembly coupled to the primary bed framework illustrated in one slidable configuration.
Figure 16B:
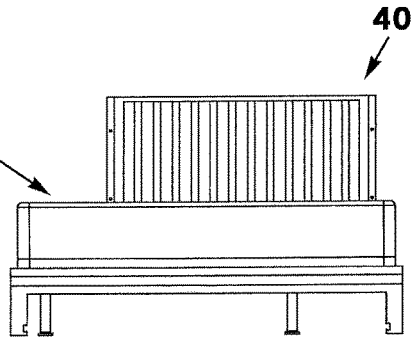
FIG. 16*b* is a side view of the crib assembly coupled to the primary bed framework illustrated in another slidable configuration.
Figure 17:
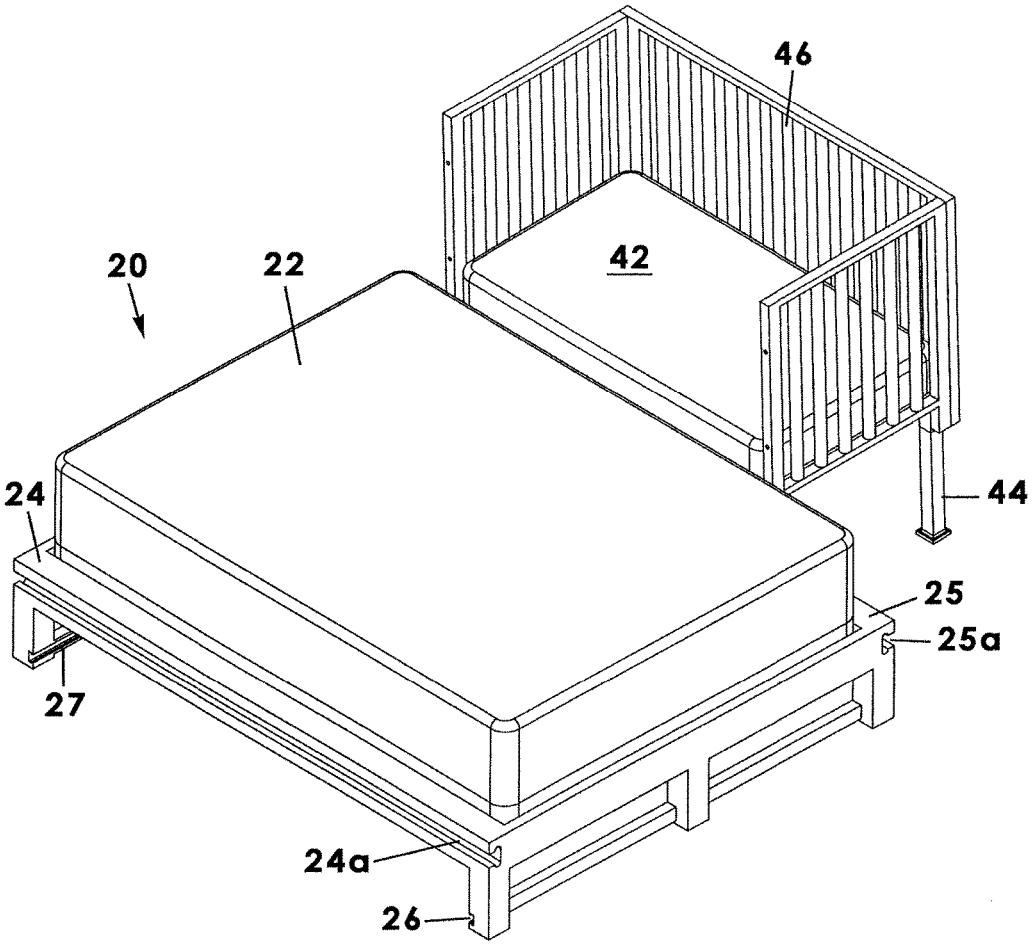
FIG. 17 is a perspective view of the crib assembly coupled to the primary bed framework as in FIG. 15 taken from a different angle.
Figure 18:
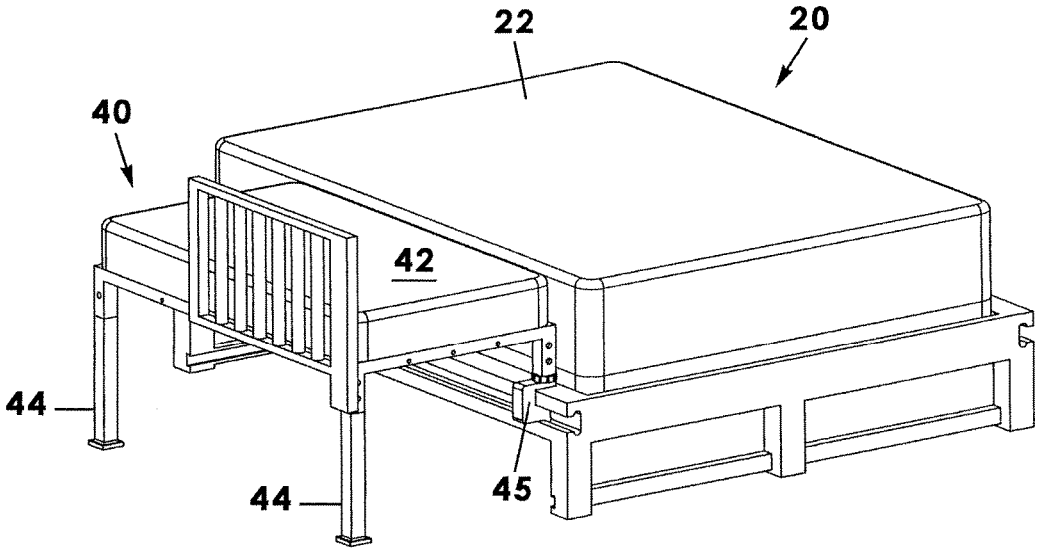
FIG. 18 is a perspective view of the crib assembly coupled to the primary bed framework, illustrated with an auxiliary panel positioned to prevent a toddler from rolling off of the auxiliary mattress.
Figure 19:
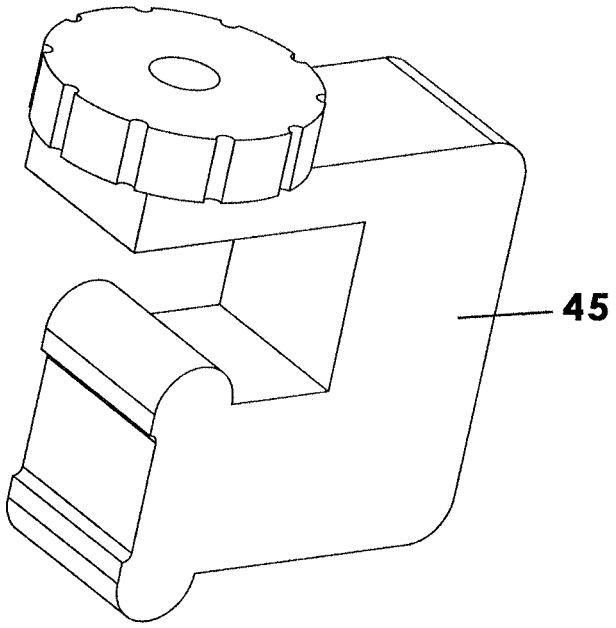
FIG. 19 is an isolated view of a crib fastener or clamp according to the present invention.
Figure 20:
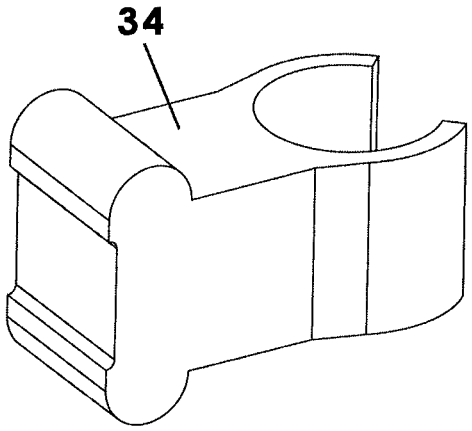
FIG. 20 is an isolated view of a slidable attachment flange used for coupling the auxiliary bed frame to the primary bed framework.

Referring now to the configuration of the crib, at least three slat panels 46 may be coupled to the crib framework and extend upwardly from a peripheral edge thereof (FIGS. 15 and 17). Preferably the three slat panels 46 represent a back and opposed ends of the crib and the panels 46 are fixed and non-adjustable although, in an embodiment, these panels are removable so that the crib 40 can be used as a standalone bed, i.e. a toddler bed. All crib support legs 44 may be removed from associated hubs so that the crib bed framework may be utilized as a toddler bed (FIG. 10). When the crib 40 is not coupled to the primary bed frame and is to be used as a traditional crib, an adjustable access slat panel 48 may be coupled to the otherwise open front side of the crib 40 (FIG. 9) in a conventional manner.

Figure 21:
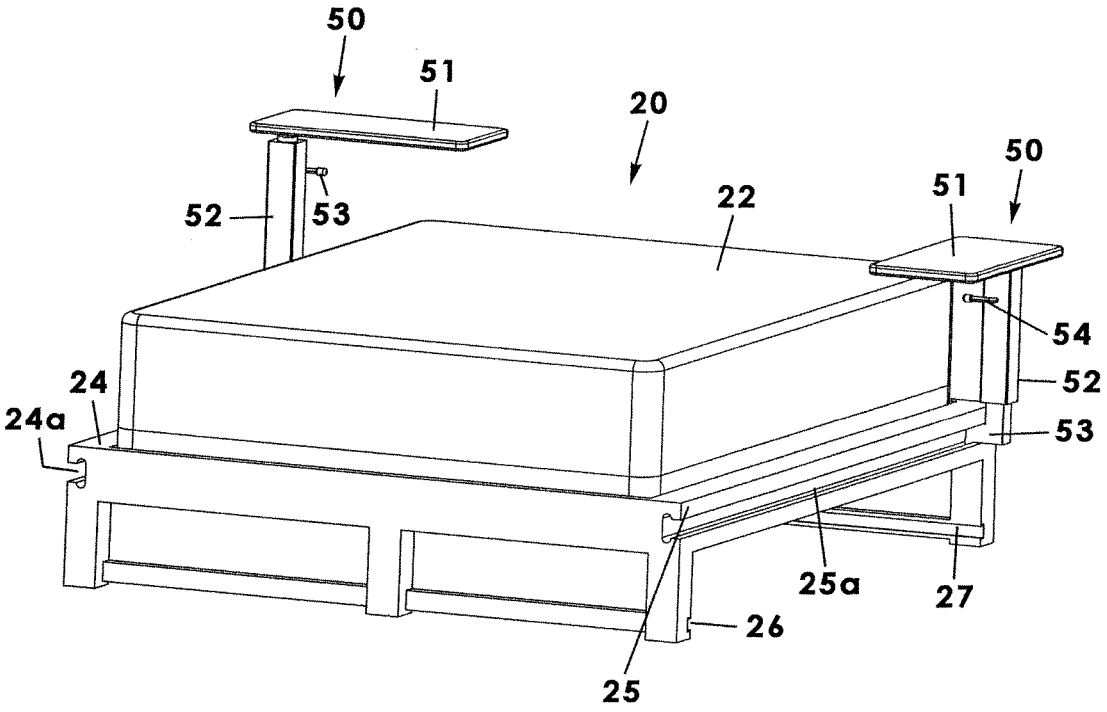
FIG. 21 is a perspective view of accessory tables coupled to the primary bed framework as in FIG. 1 according to the present invention.
Figure 22:
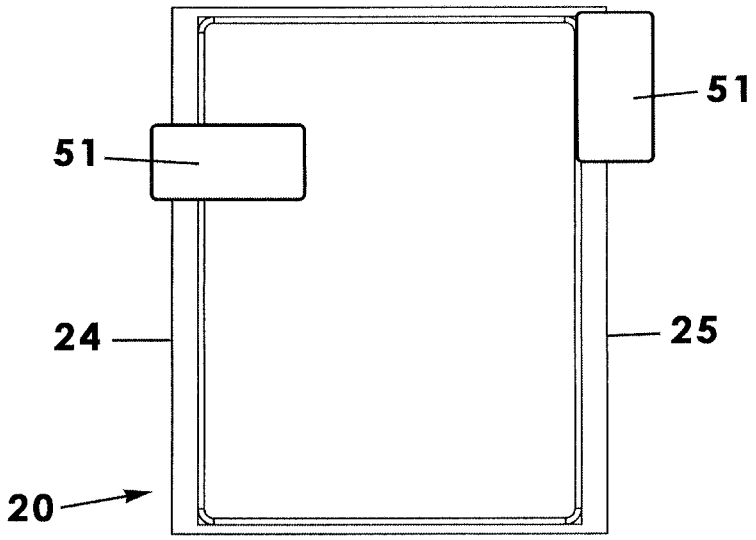
FIG. 22 is a top view of the accessory tables as in FIG. 22.
Figure 23:
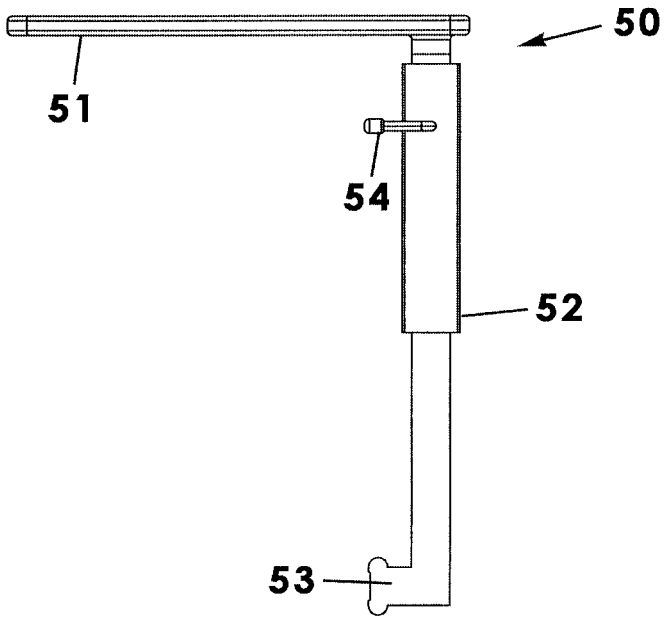
FIG. 23 is a side view of the accessory tables as in FIG. 22.

In another aspect, the co-sleeper bed system 10 may include an accessory table 50 or, preferably, a pair of accessory tables, that may be coupled to respective support members 24, 25 of the primary bed framework 20. More particularly, the accessory table 50 includes a platform 51 having a planar configuration and having a support member 52 extending downwardly therefrom (FIG. 21). In a construction substantially similar to those described previously, the accessory table 50 may include an attachment flange 53 coupled to a lower end of the support member 52 that is removably received in the channel of a respective guide rail of the primary bed framework 20. In this manner, the accessory table 50 may be slidably positioned along the respective side support member of the primary bed framework 20. In an embodiment, the support member 52 is length adjustable and may include a lever 54 operably connected to the support member 52 and configured to actuate it between length adjustments.

Figure 12A:
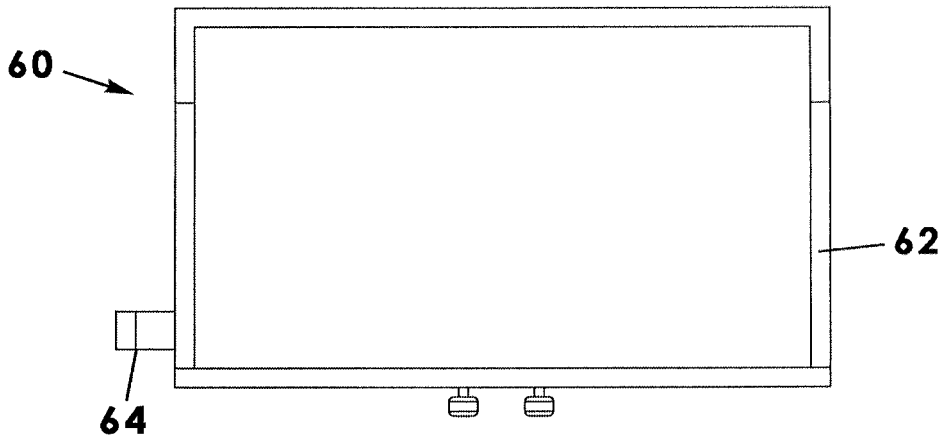
FIG. 12*a* is a top view of the changing table of the bed system shown in FIG. 1.
Figure 12B:
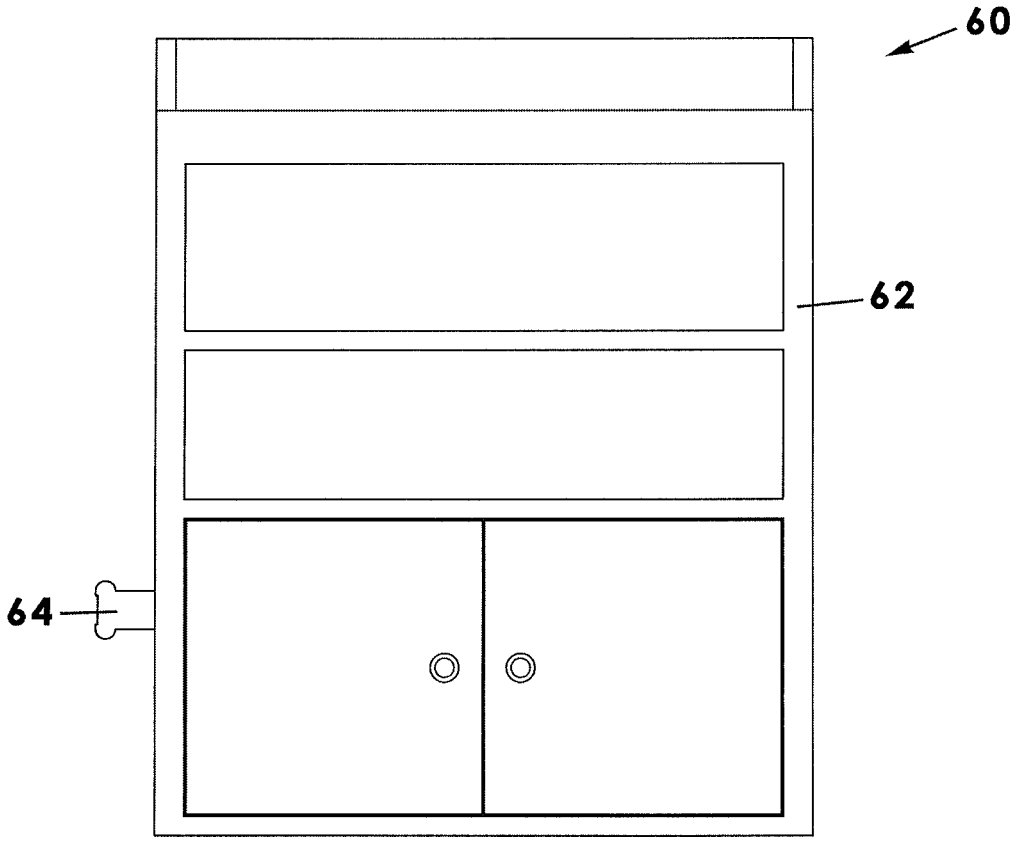
FIG. 12*b* is a front view of the changing table as in FIG. 12*a;*

In yet another aspect, the co-sleeper bed system 10 may include a changing table assembly 60 that may be coupled to respective side support members 24, 25 of the primary bed framework 20. The changing table 50 may include a cabinet body 62 and a surface having a planar configuration situated atop the cabinet body 62. In addition, the cabinet body 62 may include a fastening member 64 extending from a side wall thereof that is selectively received into a respective receiving member, i.e. guide rail, of the primary bed framework 20 and slidably movable therealong (FIGS. 1, 12*a* and 12*b*).

In use, the primary bed framework 20 may be the centerpiece of the co-sleeper bed system 10 to which the auxiliary bed frame 30, crib framework, changing table 50, and accessory table 50 may be slidably coupled in a manner such that respective upper surfaces of the primary mattress 22, auxiliary mattress 37, and crib mattress 42 may be co-planar, i.e. the same and level height. In other words, all of the mattress components share a common horizontal plane. Each of these assemblies may be selectively released or removed from attachment to the primary bed framework 20 as desired. For example, the crib 40 may no longer be needed when an infant becomes a toddler and bed components used as a toddler bed may be de-coupled from the primary bed framework 20 and moved into another room of a residence.

It is understood that while certain forms of this invention have been illustrated and described, it is not limited thereto except insofar as such limitations are included in the following claims and allowable functional equivalents thereof.

The invention claimed is:

1. A co-sleeper bed system, comprising: a primary bed framework having a primary enclosure supported above a floor surface by a support structure, said primary enclosure including a floor and first and second side members that, together, define an open top selectively receiving a primary mattress atop said floor; wherein said first side member includes a first receiving member; an auxiliary bed frame that includes an auxiliary enclosure having a plurality of frame members configured to receive an auxiliary mattress, said auxiliary bed frame having a first support leg depending from said plurality of frame members; wherein said first support leg includes a fastener removably coupled to said first receiving member of said first side member of said primary bed framework; a crib framework having a floor for supporting a crib mattress and a plurality of leg hubs having a truncated configuration extending downwardly from corners of said floor; a pair of generally C-shaped crib fasteners removably attached to a pair of inner leg hubs of said plurality of leg hubs, each crib fastener being removably coupled to a second receiving member of said second side member of said primary bed framework, said second receiving member is a second guide rail defining a channel; each crib fastener of said pair of crib fasteners is a slider flange slidably received in said channel of said second guide rail for removably coupling said crib framework to said primary framework; a pair of outer support legs removably coupled to and extending downwardly from a pair of outer leg hubs of said plurality of leg hubs for supporting said crib framework when said pair of crib fasteners is coupled to said second receiving member of said second side member of said primary bed framework; a pair of inner support legs removably coupled to and extending downwardly from said inner leg hubs, respectively, when said slider flanges are removed from said inner leg hubs.

2. The co-sleeper bed system as in claim 1, wherein: said first receiving member is a first guide rail defining a channel; said fastener is a flange slidably received in said channel of said first guide rail.

3. The co-sleeper bed system as in claim 2, wherein a top of the auxiliary mattress is level with a top of the primary mattress when said fastener is received in said channel of said first guide rail.

4. The co-sleeper bed system as in claim 1, wherein said first support leg is pivotally mounted to a respective frame member of said auxiliary bed frame and is pivotally movable between a stowed configuration underneath and parallel with said plurality of frame members and a deployed configuration extending away from said plurality of frame members so as to support said auxiliary bed frame above the floor surface.

5. The co-sleeper bed system as in claim 4, wherein said auxiliary bed frame includes a second support leg displaced from said first support leg and pivotally coupled to another respective frame member of said auxiliary bed frame and is pivotally movable between a stowed configuration underneath and parallel with said plurality of frame members and a deployed configuration extending away from said plurality of frame members so as to support said auxiliary bed frame above the floor surface.

6. The co-sleeper bed system as in claim 1, wherein said auxiliary bed frame includes a handle coupled to a respective frame member opposite said fastener.

7. The co-sleeper bed system as in claim 5, wherein said auxiliary bed frame has a flat configuration for storage under said primary bed framework when said first and second support legs are at said stowed configurations, respectively, said auxiliary bed frame having a peripheral dimension smaller than a peripheral dimension of said support structure of said primary bed framework.

8. The co-sleeper bed system as in claim 7, wherein: said support structure includes a front guide rail extending between said first and second side members and a rear guide rail extending between said first and second side members; said plurality of frame members of said auxiliary bed frame include a pair of end frame members having rollers selectively engaged with said front and said rear guide rails, respectively, for stowing said auxiliary bed frame beneath said primary bed framework.

9. The co-sleeper bed system as in claim 1, further comprising at least three slat panels removably coupled to said crib framework and extending upwardly therefrom so as to collectively block access from three sides and define an open side proximate said primary bed framework wherein said crib mattress is in communication with said primary bed mattress.

10. The co-sleeper bed system as in claim 9, wherein a top of said crib mattress is level with a top of said primary mattress.

11. The co-sleeper bed system as in claim 9, further comprising an access slat panel selectively coupled to said open side of said crib framework when said pair of crib fasteners are removed from attachment to said second receiving member of said primary bed framework.

12. The co-sleeper bed system as in claim 2, further comprising an accessory table that includes a platform having a planar configuration and a support member extending downwardly from said platform, said accessory table having an attachment flange coupled to a lower end of said support member that is removably received in said channel of said first guide rail.

13. The co-sleeper bed system as in claim 12, wherein said support member is length adjustable.

14. The co-sleeper bed system as in claim 1, further comprising a changing table assembly that includes a cabinet body and a surface having a planar configuration atop said cabinet body, said cabinet body having a fastening member extending from a side wall of the cabinet body that is selectively received by said second receiving member of said second side member of said primary bed framework.

15. The co-sleeper bed system as in claim 14, wherein: said fastening member is a slider flange slidably received in said channel of said second guide rail for removably coupling said cabinet body to said primary framework.

16. A co-sleeper bed system, comprising: a primary bed framework having a primary enclosure supported above a floor surface by a support structure, said primary enclosure including a floor and first and second side members that, together, define an open top selectively receiving a primary mattress atop said floor; wherein said first side member includes a first guide rail defining a channel; wherein said second side member includes a second guide rail defining a channel; an auxiliary bed frame that includes an auxiliary enclosure having a plurality of frame members configured to receive an auxiliary mattress, said auxiliary bed frame having a first support leg depending from said plurality of frame members; wherein said first support leg includes a flange slidably received in said channel of said first guide rail; wherein a top of the auxiliary mattress is level with a top of the primary mattress when said flange is received in said channel of said first guide rail; a crib framework having a floor for supporting a crib mattress and a plurality of leg hubs each having a truncated configuration extending downwardly from corners of said floor; a pair of generally C-shaped slider flanges attached to a pair of inner leg hubs of said plurality of leg hubs, each slider flange being slidably received in said channel of said second guide rail for removably coupling said crib framework to said primary framework; a pair of outer support legs removably coupled to and extending downwardly from a pair of outer leg hubs of said plurality of leg hubs for supporting said crib framework when said pair of crib fasteners is coupled to said channel of said second side member of said primary bed framework; a pair of inner support legs removably coupled to and extending downwardly from said inner leg hubs, respectively, when said slider flanges are removed from said inner leg hubs.

* * * * *